US007117569B2

(12) United States Patent
Bledsoe

(10) Patent No.: US 7,117,569 B2
(45) Date of Patent: Oct. 10, 2006

(54) ADJUSTABLE RATCHET BUCKLE FASTENER

(75) Inventor: Gary R. Bledsoe, Mansfield, TX (US)

(73) Assignee: Medical Technology, Inc., Grand Prairie, TX (US)

( * ) Notice: Subject to any disclaimer, the term of this patent is extended or adjusted under 35 U.S.C. 154(b) by 95 days.

(21) Appl. No.: 11/053,820

(22) Filed: Feb. 9, 2005

(65) Prior Publication Data

US 2006/0174459 A1 Aug. 10, 2006

(51) Int. Cl.
*A44B 11/25* (2006.01)

(52) U.S. Cl. ..... 24/593.11; 24/633; 24/DIG. 48; 24/596.1; 24/648

(58) Field of Classification Search ..... 24/633, 24/596.1, 591.1, 593.11, 16 PB, DIG. 47, 24/DIG. 48, DIG. 51, DIG. 60
See application file for complete search history.

(56) References Cited

U.S. PATENT DOCUMENTS

| | | | | |
|---|---|---|---|---|
| 215,956 | A * | 5/1879 | Miller | 24/593.11 |
| 809,465 | A * | 1/1906 | Roy et al. | 24/593.11 |
| 1,627,776 | A * | 5/1927 | Haumerson | 24/593.11 |
| 3,112,496 | A | 12/1963 | Dritz | |
| 3,808,643 | A | 5/1974 | Gouge | |
| 3,827,107 | A | 8/1974 | Moore | |
| 3,860,997 | A * | 1/1975 | Van Riper et al. | 24/16 PB |
| 4,005,506 | A | 2/1977 | Moore | |
| 4,310,110 | A | 1/1982 | Dexter | |
| 4,378,793 | A | 4/1983 | Mauldin et al. | |
| 4,577,375 | A * | 3/1986 | Beaussant | 24/593.1 |
| 5,201,100 | A | 4/1993 | Cardinale | |
| 5,502,843 | A | 4/1996 | Strickland | |
| 5,548,871 | A | 8/1996 | Trethewey | |
| 6,131,249 | A | 10/2000 | Suenaga | |
| 6,163,941 | A | 12/2000 | Lai | |
| 6,360,410 | B1 | 3/2002 | Lovato | |
| 6,631,537 | B1 | 10/2003 | Huang | |
| 6,748,630 | B1 | 6/2004 | Livingston | |
| 6,760,958 | B1 | 7/2004 | Tejima | |
| 6,766,532 | B1 | 7/2004 | Cabana | |

* cited by examiner

*Primary Examiner*—Robert J. Sandy
(74) *Attorney, Agent, or Firm*—Locke Liddell & Sapp LLP; Mark R. Backofen

(57) ABSTRACT

An adjustable fastener such as one suitable for use in securing straps in a variety of orthotic and other types of devices. The fastener has a male portion and a female portion that are each attached to a strap or other desired location on the device with which the fastener is used. The male portion has an elongated tab and the female portion has a housing and a passage through the housing. The passage allows the elongated tab to slide through the housing in the female portion. An engagement finger in the housing is resiliently biased to engage one or more teeth along an edge of the elongated tab to prevent the elongated tab from sliding further out of the passage. The finger can be selectively disengaged from the teeth to allow the elongated tab to slide further or completely out of the housing.

24 Claims, 3 Drawing Sheets

ADJUSTABLE RATCHET BUCKLE FASTENER

BACKGROUND OF THE INVENTION

1. Field of the Invention

This invention relates generally to an adjustable fastener and, more particularly, to an adjustable fastener that can be used to secure the end of a brace strap.

2. Description of Related Art

Various types of buckles, clips, and other connectors that can be used in various orthotic and other types of devices such as to secure one end of a strap either to another portion of the same strap or to some other anchor point in the device are known to those of skill in the art. Some examples of previously disclosed buckles include those described in U.S. Pat. Nos. 3,112,496; 3,808,643; 3,827,107; 4,005,506; 4,310,110; 4,378,793; 5,201,100; 5,548,871; 5,502,843; 6,131,249; 6,163,941; 6,360,410; 6,631,537; 6,748,630; 6,760,958; and 6,766,532.

Not all types of fasteners are appropriate for any given particular application. In particular, there are special considerations for fasteners that are used to secure and tension straps on medical braces and other orthopedic devices. These fasteners should have an extremely low profile so that they do not interfere with the operation of the brace, hinder normal physiological movement of the body, or become accidentally opened if jarred. They also need to be able to allow the strap to be sufficiently tensioned and be of sufficient strength to withstand such tension force without failure. It is also beneficial if the fasteners are easy to operate so the patient can remove the device and easily returned to its original tension setting when the strap is refastened.

In the field of braces and orthopedic devices, two types of fasteners are prevalent. One of the most common type of fastener used are hook and loop fasteners (i.e. Velcro), often in combination with a D-ring. The D-ring is secured to an anchor point on the device, which may be one end of the strap itself or a brace shell or support. An end of the strap passes through the D-ring and doubles back on itself. The outer surface of the strap is composed of a material that forms the loop portion of the fastening system. At the end of the strap is a section of hooks that form the hook portion of the fastening system. The hook section can be used to secure the end of the strap to any point along the strap itself. By adjusting the location where the strap end is secured to itself, the length of the strap and hence the amount of tension that is applied by the strap can be controlled. If no D-ring is used, one portion of the fastener (e.g. the hook portion) can be located directly on an anchor point, such as a shell on a brace or the other end of the strap, and the other portion can be located on the end of the strap.

Hook and loop fastening systems are able to provide sufficient shear strength to prevent the strap from loosening or coming unfastened, while at the same time allowing the patient or physician to quickly and easily remove the strap and/or adjust the tension of the strap. It also can allow infinite variability in the amount of tension applied to the strap. While this type of fastener makes it easy for a patient to undo the straps to remove the brace when it is not needed, it can be difficult for the patient to refasten the strap with the exact amount of tension that was present when the strap was removed. In addition, hook and loop fasteners tend to wear out over time, especially when they are frequently opened and closed as would occur when a brace is removed daily for such activities as bathing, physical therapy, and/or sleeping. This may require the straps on a brace to be replaced every 3–6 months.

Another common category of fasteners in bracing and orthopedic devices is made up of various types of snap fasteners. While snap fasteners are more durable than the hook and loop fasteners, they are generally difficult to close when a significant amount of tension must be placed on the strap. The user often must place a higher amount of tension on the strap than the strap will provide once closed, while at the same time aligning the snap portions and often applying an additional force to snap the sections together. This is often difficult to achieve, especially for individuals who are weakened or have limited strength, and can result in the patient's skin being pinched between the portions of the snap. Many snap fasteners are also not adjustable. Adjustable fasteners that ratchet, such as are sometimes used in ski boots, have the ratcheting surface on the wide top surface of the strap and are too thick and bulky for use in braces and other orthotic devices. Therefore, there still remains a need for a fastener that is adjustable, easy to operate, and appropriate for use in braces and other orthotic devices.

SUMMARY OF THE INVENTION

The invention relates to an adjustable fastener such as one suitable for use in securing straps in a variety of orthotic and other types of devices. The fastener comprises a male portion and a female portion that are each attached to a strap or other desired location on the device with which the fastener is used. The male portion comprises an elongated tab and the female portion comprises a housing and a passage through the housing. The passage allows the elongated tab to slide through the housing in the female portion. An engagement finger in the housing is resiliently biased to engage one or more teeth along an edge of the elongated tab to prevent the elongated tab from sliding further out of the passage. The finger can be selectively disengaged from the teeth to allow the elongated tab to slide further or completely out of the housing. Preferably there are teeth along both edges of the elongated tab and there is a finger in the housing adapted to separately engage each set of teeth. It is additionally preferable that the elongated tab can be ratcheted further into the housing by sliding it without disengaging the engagement finger.

BRIEF DESCRIPTION OF THE DRAWINGS

The preferred embodiments of the apparatus of the invention are further described and explained in relation to the following figures wherein.

DETAILED DESCRIPTION OF THE PREFERRED EMBODIMENT

Figure 1:
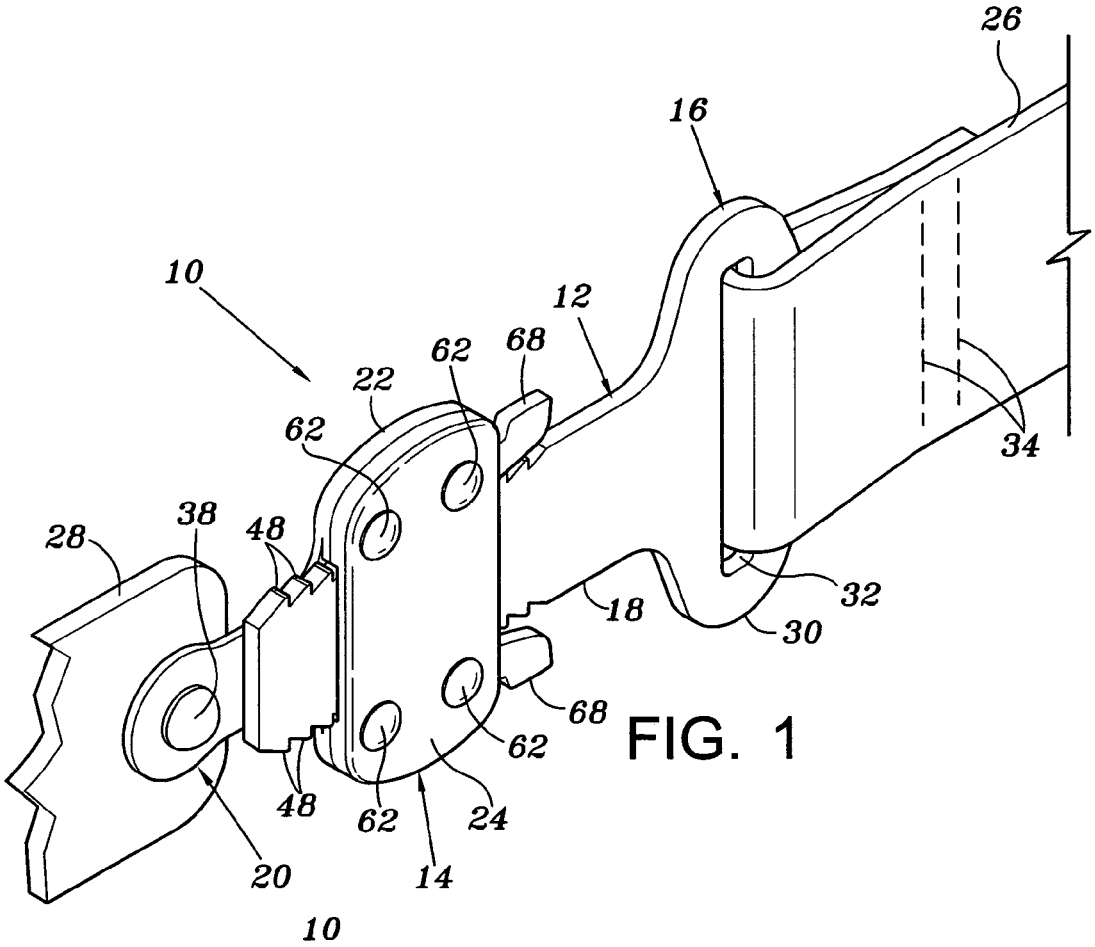
FIG. 1 is a perspective view of a preferred fastener according to the current invention securing a strap to an anchor point in a brace.

The following description will describe the structure and function of the claimed fastener in terms of the preferred embodiments. In discussing the various embodiments of the current invention, corresponding structure will be identified using the same reference numerals. Preferably the parts of the fastener are formed from a polymeric material and most preferably from ST801 Nylon, however those of skill will recognize that many other materials can be appropriate for use in all or portions of the disclosed fastener. Various parts may include up to about 13% glass fibers in the ST801 Nylon, which improves its stiffness and dimensional stability. The inclusion of glass fibers is especially desirable for engagement fingers 54 and leaf springs 66 to help provide the desired strength and spring tension.

Those of skill in the art will recognize the many purposes for which the fastener of the current invention can be used. Preferably, the fastener is adapted for use in securing and tensioning straps of a brace or other orthotic device to assist in holding the brace or device in the desired position on the patient's body and/or applying the desired therapeutic forces. For example, the fastener can be used in conjunction with the Dynamically shiftable counter shear force knee brace disclosed in U.S. Pat. No. 4,955,369 to secure one or more of the various straps used to secure the brace in place on the leg and apply the necessary therapeutic forces. The fastener can also be used in conjunction with hook and loop fasteners to secure the end of an adjustable length strap to the shell of a brace, such as the one in the Muscle Powered Dynamic Knee Brace disclosed in U.S. application Ser. No. 10/774,657, filed by applicant on Feb. 5, 2004. In this case, fastener 10 can be used to replace the D-ring and web attachment portion used in conjunction with straps 46 and 60 on that brace, with one portion of the fastener secured to the strap and the other portion secured to the shell of the brace. Likewise, the disclosed fastener can be used in many other types of orthotic and other types of devices.

Figure 2:
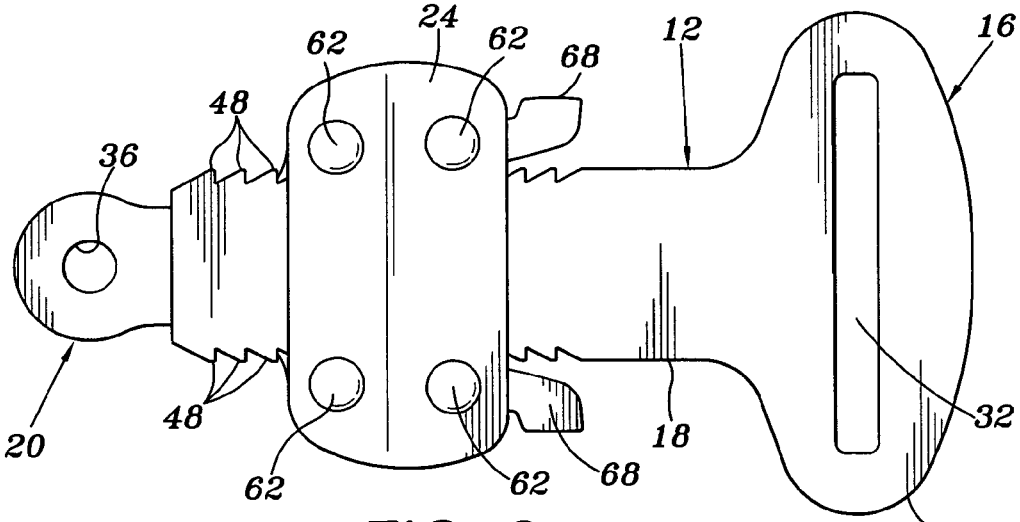
FIG. 2 is a front elevation view of the preferred fastener shown in FIG. 1.

Referring to FIGS. 1 and 2, fastener 10 is composed of two portions, male portion 12 and female portion 14. Male portion 14 is generally composed of attachment point 16 and elongated tab 18. Female portion 14 is generally composed of attachment point 20, and a housing comprising base 22, side rails 58, and housing cover 24. Attachment points 16 and 20 can be adapted for any currently known or later developed method of attaching male portion 12 and female portion 14 to either an end of a strap, such as strap 26, or to anchor point 28, such as a shell of a brace.

As shown in FIGS. 1 and 2, attachment point 16 is composed of D-ring 30 defining slot 32 and allows male portion 12 to be attached to strap 26. Strap 26 passes through slot 32 and doubles back onto itself. Strap 26 may be sewn back onto itself using stitches 34. In this manner male portion 12 is attached to strap 26. Alternatively, hook and loop fasteners, such as Velcro, can be used to secure strap 26 back onto itself instead of stitches 34. The use of hook and loop fasteners can be used to set the desired amount of tension on strap 26. Fastener 10 is then used to completely release strap 26, thereby preventing the hook and loop fasteners from wearing out from repeated use. Fastener 10 would also allow an individual to more easily duplicate the amount of tension that was previously being applied by strap 26 as well as make minor adjustments to the amount of tension on strap 26.

Attachment point 20 on female portion 14 shows alternative structure that allows female portion 14 to be attached to anchor point 28 through the use of a connector such as connector 38. Attachment point 20 contains a hole 36 through which a connector 38 can be used to secure female portion 14 to anchor point 28. If desired, connector 38 can be used to provide a pivotal attachment between female portion 14 and anchor point 28. A pivoting attachment point 20 allows the end of strap 26 to pivot to the correct angle, which may vary based upon the individual patient or even based upon the current position of the limb to which the orthotic device is secured. If desired attachment point 20 can be formed integrally with base 22 as opposed to extending out from base 22 and housing cover 24 as is shown in the figures. In such case, hole 36 can be located directly in base 22, providing a more compact female portion 14. When hole 36 is located in base 22, it will generally be desirable to further include an access hole in housing cover 24 to allow female portion 14 to be secured to anchor point 28 after female portion 14 has been fully assembled.

Figure 4:
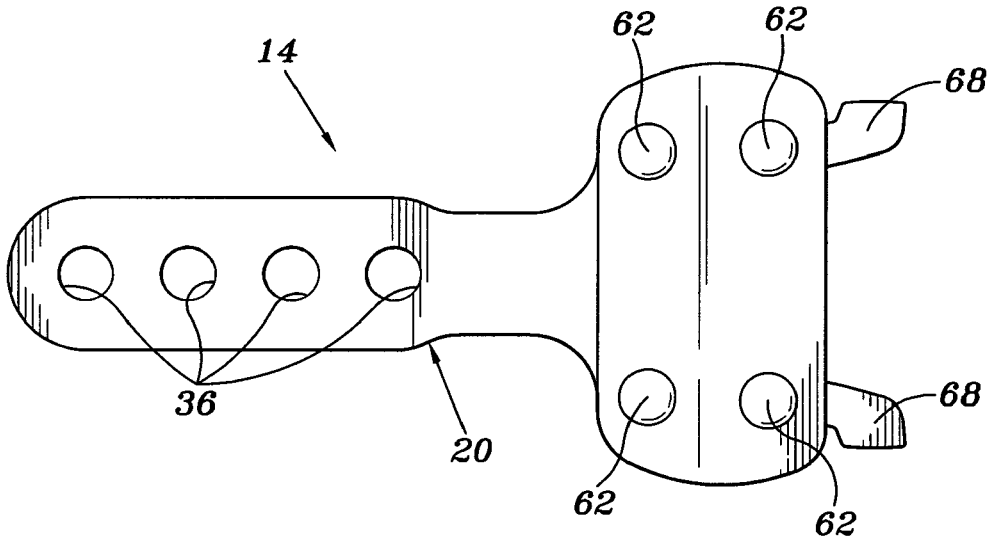
FIG. 4 is a front elevation view of the female portion of the fastener.

As shown in FIG. 4, attachment point 20 may be elongated so that it can encompass a series of holes 36 to provide alternatives for attaching female portion 14 to anchor point 28. This allows the appropriate hole 36 to be used to secure female portion 14 to anchor point 28 to provide approximately the appropriate amount of tension in strap 26 when fastener 10 is closed. This can be done in a permanent fashion when the device is first fitted or it may be possible to later switch connector 38 to a different hole 36 to accommodate significant changes in the tension requirements on strap 28. Once the approximate amount of tension is provided, the adjustable nature of fastener 10 can be used to fine-tune the desired tension in a measured and repeatable manner as well as allow strap 26 to be easily removed.

Figure 3:
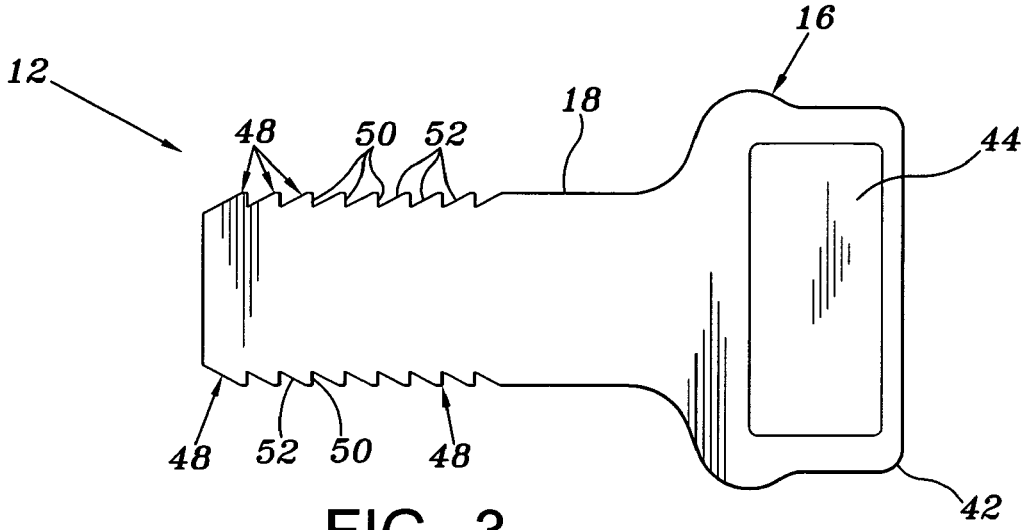
FIG. 3 is a front elevation view of the male portion of the fastener of another preferred embodiment using a sew tab anchor.

FIG. 3 depicts another alternative attachment point 16 in the form of a sew tab. The sew tab comprises frame 42 surrounding platform 44. Platform 44 is of a reduced thickness, such that the needle in a sewing machine can puncture platform 44 in the process of sewing the end of strap 26 to sew tab 40. In this way, strap 26 is secured to male portion 12. Any of the above attachment points 16 or 20, or other methods of attaching known to those of skill in the art, can be used interchangeably with either male portion 12 or female portion 14. The particular attachment point to be used for male portion 12 and female portion 14 can be chosen by one of skill in the art depending upon the particular structure and purpose of the device with which fastener 10 is being used.

As depicted in FIG. 3, elongated tab 18 on male portion 12 contains a plurality of track teeth 48 along both edges. Track teeth 48 are each composed of flat shoulder 50 on the side closest to attachment point 16 and inclined plane 52 on the side closest to female portion 14. Shoulder 50 is perpendicular to the axis of elongated tab 18 and inclined plane 52 angles up from the bottom of shoulder 50 of one track tooth 48 to the top of shoulder 50 of adjacent track tooth 48. The elongated tab 18 on male portion 12 is particularly flexible by design, such that it can flex in and out as well as twist to some degree. This flexibility can allow fastener 10 to provide a more comfortable fit by allowing it to bend to some extent so fastener 10 is less likely to create a pressure point against the individual wearing the device.

Figure 5:
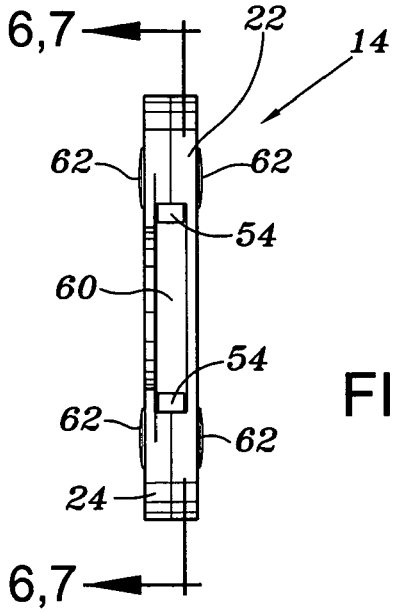
FIG. 5 is a side elevation view of the female portion of the fastener.

As can be seen more clearly in FIGS. 4–7, female portion 14 comprises attachment point 20 and a housing comprising base 22, rails 58, engagement finger 54, and housing cover 24. Rails 58 are located on either side of base 22 and housing cover 24, although rails 58 can be completely located on either base 20 or housing cover 24 as well. Rails 58 on base 22 contact rails 58 on housing cover 24 such that base 22 and housing cover 24 are spaced apart to define passage 60 through female portion 14, as seen in FIG. 5. Rails 58 are preferably of a sufficient height and base 22 and housing cover 24 are of a sufficient size such that passage 60 is large enough for elongated tab 18 to pass through passage 60 in sliding engagement with both base 22 and housing cover 24. For use in braces and orthotic devices, it is preferable for the thickness of elongated tab 18 to be minimized to the extent possible without sacrificing desired strength, in order to keep the overall profile of fastener 10 as low as possible. Rivets 62 are used to hold base 22 and housing cover 24 together. Instead of rails 58, fastener 10 may contain sleeves surrounding rivets 62 that extend between base 22 and/or housing cover 24 and space base 22 apart from housing cover 24 to form passage 60.

Figure 6:
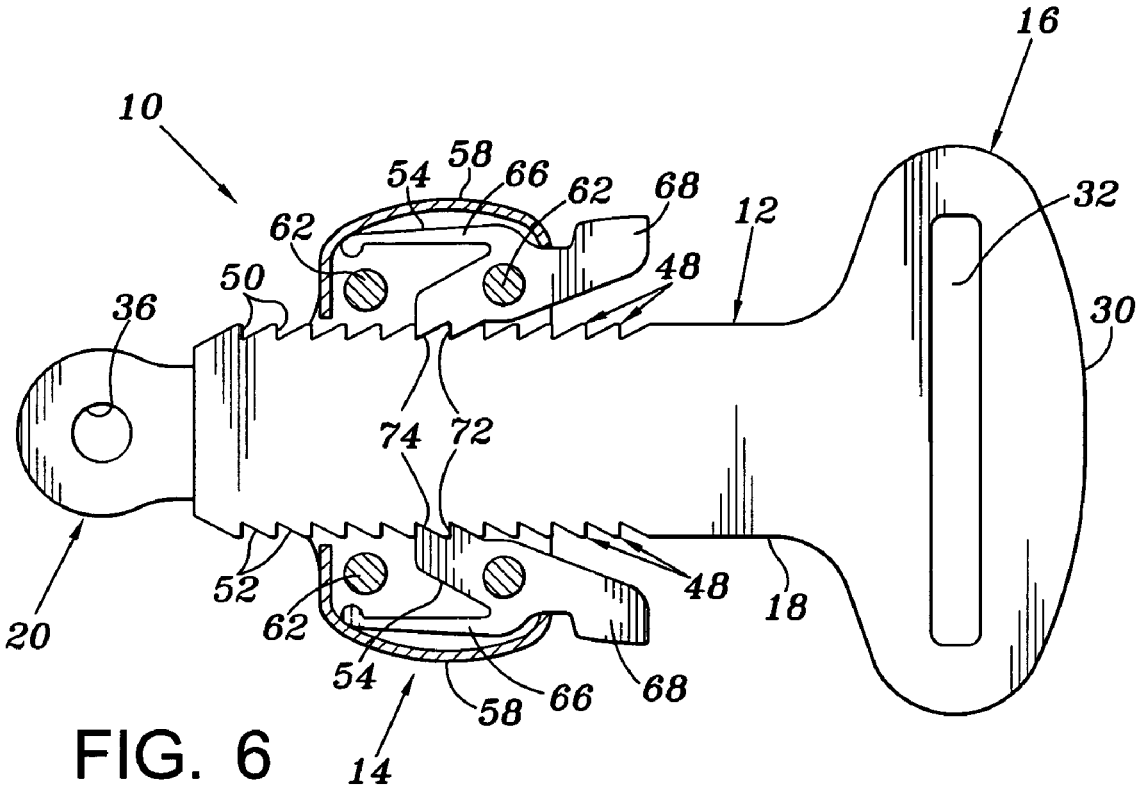
FIG. 6 is a cross section view taken along line 6—6 in FIG. 2 with the engagement fingers engaged with the teeth.
Figure 7:
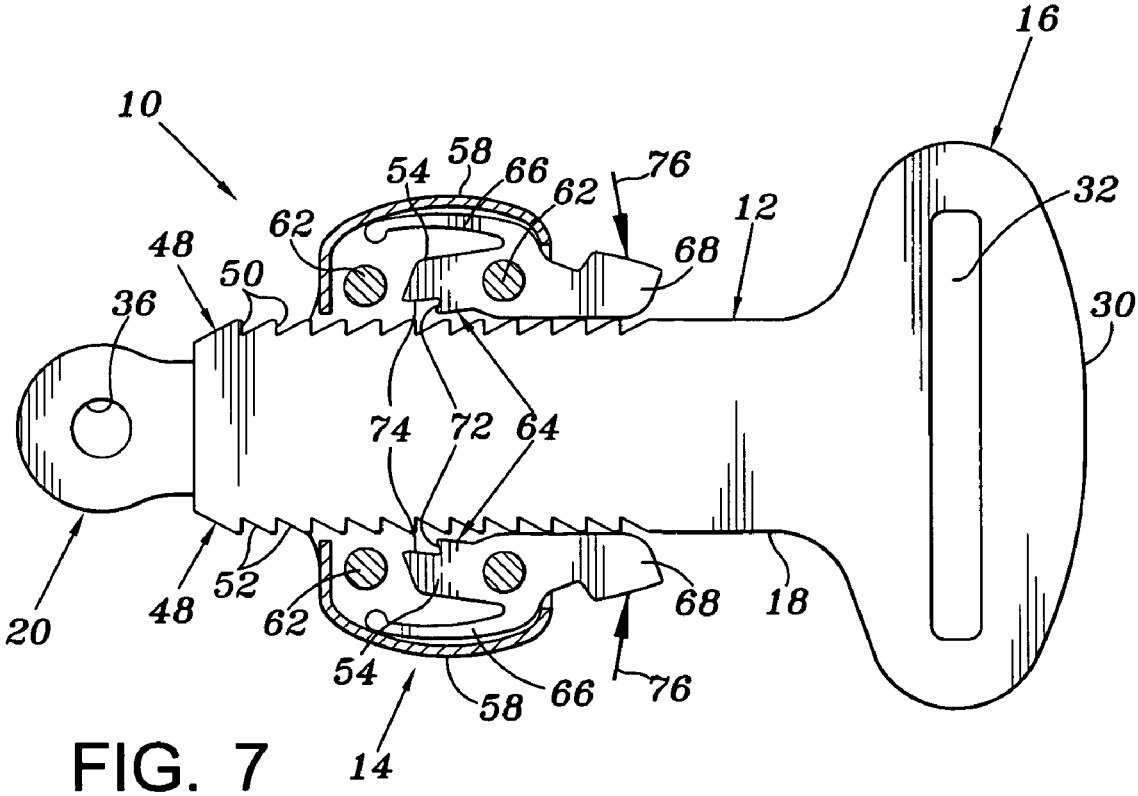
FIG. 7 is a cross section view taken along line 6—6 in FIG. 2 with the engagement fingers disengaged from the teeth.

As shown in FIGS. 6 and 7, each engagement finger 54 is pivotally connected between base 22 and housing cover 24 by one of the rivets 62. Each engagement finger 54 is composed of a plurality of engagement teeth 64, leaf spring 66, and arm 68. Engagement teeth 64 are located at one end of engagement finger 54 and are each shaped to compliment track teeth 48 on the elongated tab 18. Each finger tooth 64 comprises shoulder 72 and inclined plane 74. Leaf springs 66 are each positioned such that they are further compressed against rails 58 when the end of the respective engagement finger 54 containing engagement teeth 64 is rotated away from passage 60. Leaf springs 66 can be formed either integrally with engagement fingers 54, as shown in FIGS. 6–7, or they can be separate structures. Leaf springs 66 bias the end of engagement fingers 54 containing engagement teeth 64 toward passage 60 so that engagement teeth 64 engage track teeth 48. If rails 58 are not used as a stop for leaf springs 66, one of rivets 62 can be so used or a separate stop can be positioned between base 22 and housing cover 24. In either case, leaf springs 66 are compressed when the respective engagement finger is pivoted around rivet 62 such that it biases the end of engagement finger 54 containing engagement teeth 64 toward passage 60 so engagement teeth 64 remain engaged with track teeth 48 when no force is being applied to engagement finger 54 through arm 68.

Arms 68 of engagement fingers 54 each extends outside of housing 24 and allow an individual to manually disengage engagement teeth 64 of each engagement finger 54 from track teeth 48. As seen in FIG. 7, application of forces 76 to arms 68 rotates engagement fingers 54 around rivets 62 moving engagement teeth 64 out of engagement with track teeth 48 and compressing leaf springs 66. With engagement teeth 64 of both engagement fingers 54 moved out of engagement with track teeth 48, elongated tab 18 is free to slide further out of passage 60 and away from female portion 14, thereby allowing strap 26 to be loosened to some extent or for male portion 12 to be completely removed from female portion 14 to open fastener 10. Upon release of force 76, the biasing action of leaf springs 66 rotates engagement fingers 54 back around so that engagement teeth 64 once again engage track teeth 48, thereby preventing elongated tab 18 from sliding further out of passage 60.

Track teeth 48 and engagement teeth 64 are shaped so that when engaged they allow the ratcheting of the fastener further into passage 60 to tighten strap 26 while preventing it from being loosened by sliding further out of passage 60. Shoulders 50 and 72 contact each other and prevent elongated tab 18 from sliding further out of passage 60, thereby loosening the tension on strap 26 or opening fastener 10. However, if elongated tab 18 is slid further into passage 60, inclined planes 52 and 74 contact each other. The angle of inclined planes 52 and 74 is such that the end of engagement finger 54 containing engagement teeth 64 is rotated away from passage 60 so that inclined plane 74 can ride up inclined plane 52. When finger tooth 64 reaches the high point of inclined plane 52 of one tooth, further sliding elongated tab 18 into passage 60 will result in the biasing action of leaf springs 66 pushing finger tooth 64 down into the notch formed by shoulder 72 of one tooth and inclined plane 52 of the next adjacent tooth. Shoulders 50 and 72 will prevent elongated tab 18 from sliding further out of passage 60 and back to its original position. As a result, elongated tab 18 can be ratcheted further into passage 60 without disengaging engagement finger 54, thereby tightening the tension on strap 26 in discrete but small increments without having to apply forces 76 to arms 68 and risking fastener 10 opening or loosening up. On the other hand, elongated tab 18 cannot be slid further out of passage 60, either to loosen the tension on strap 26 or to open fastener 10 without applying forces 76 to disengage engagement fingers 54 from tracks 46 on elongated tab 18 due to the contact of shoulder 50 on track teeth 48 and shoulder 72 on engagement teeth 64. Further, when two engagement fingers are used, as in the preferred embodiments, forces 76 must both be simultaneously applied to arms 68 to disengage both engagement fingers 54 from track teeth 48 in order to be able to slide elongated tab 18 further out of passage 60 to loosen strap 26 or completely open fastener 10.

Straps in braces and other orthotic devices must be secured with sufficient tension to hold the brace or device in its intended place. Insufficient tension on straps 26 will allow the brace or device to shift or come off, reducing its benefit or even becoming counterproductive. On the other hand, excess tension will often cause discomfort with the patient, restrict circulation, and may lead to the patient not wearing the brace as often as is recommended. Obtaining the appropriate amount of tension each time the patient secures the strap is even more important when the amount of tension on a particular strap in part regulates the amount of therapeutic force that is being applied by the device.

The presence of multiple track teeth 48 on each edge of elongated tab 18 allows fastener 10 to provide a way of adjusting the tension on the strap in a repeatable manner in addition to operating as a fastener for the strap. A number of track teeth 48 sufficient to provide the desired range of adjustability for the particular strap can be provided on each edge of elongated tab 18. Alternatively, other means may be used to provide the approximate amount of tension required and sufficient track teeth 48 are included on each edge of elongated tab 18 to provide the necessary range of fine-tuning adjustment and accommodate any fluctuations in the desired amount of tension that may occur. For example, the attachment of fastener 10 to the device through either attachment point 16 or 20 can be adjustable to provide the desired approximate adjustment. One way of accomplishing this, as shown in FIG. 4, is the use of multiple holes 36 in attachment point 20 for selectively mounting one portion of fastener 10 to anchor point 28 in the desired position. Another way of accomplishing this is to use D-ring 30 with strap 26 passing through slot 32 and secured back to itself using snaps or hook and loop closures, i.e. Velcro, instead of stitches 34.

Fastener 10 avoids the tensioning and closure problems often associated with snap-type fasteners by allowing the individual to close fastener 10 at a lower tension level and then adjusting the tension up to the desired amount in small discrete amounts by sliding the elongated tab further into passage 60, without having to reopen fastener 10. This is accomplished by providing an elongated tab 18 with sufficient track teeth 48 so that the first track tooth 48 engages the engagement teeth 64 on engagement finger 54 with a relatively low amount of tension. At this point fastener 10 is closed and male portion 12 and female portion 14 are fixed relative to each other. Elongated tab 18 can then be further slid into passage 60 to ratchet engagement teeth 64 sequentially to track teeth 48 along elongated tab 18, thereby adjusting fastener 10 in discrete increments to tighten strap 26 without opening fastener 10.

A particularly preferred embodiment of fastener 10 combines male portion 12 with D-ring 30 where one end of strap 26 is looped through slot 32 in D-ring 30 and secured back on itself using hook and loop closures, i.e. Velcro, in place of stitches 34. The use of hook and loop closure on strap 26 allows for an infinitely variable adjustment to the length of strap 26, thereby adjusting its tension. Once initially set, the hook and loop fasteners are left in place and fastener 10 is used to release strap 26 when necessary to remove the device as well as to provide any slight adjustment to the tension on strap 26 that is required. The use of fastener 10 in connection with hook and loop fasteners on strap 26 allows the patient to repeatedly duplicate the amount of tension previously placed on strap 26 by either the user or a medical professional as well as fine tune the amount of tension on strap 26 simply by counting the "clicks" made as engagement finger 54 sequentially engages each track tooth 48. Fastener 10 also prevents the hook and loop from wearing out over time due to repeatedly opening and closing of strap 26.

One of skill in the art will recognize that the dimensions of track teeth 48 on elongated tab 18, engagement teeth 64, and the thickness of elongated tab 18 will depend upon the strength required for the particular application and any size limitations for using fastener 10 in a particular brace or orthotic device. For example, increasing the thickness of elongated tab 18 and engagement fingers 54 will increase the thickness of track teeth 48 and engagement teeth 64 and thus the contacting surface area of shoulders 50 and 72, thereby increasing the strength of fastener 10. The use of track teeth 48 along both edges of elongated tab 18 can also be used to effectively double the surface area of shoulders 50 and 72 contacting each other when compared to the use of track 46 on only one edge of elongated tab 18, thereby increasing the strength of fastener 10 without requiring any additional thickness to fastener 10. The use of track teeth 48 along both edges of elongated tab 18 also helps prevent the unintentional opening of fastener 10. When fastener 10 has two sets of track teeth 48 and two engagement fingers 54, forces 76 must be applied to both arms 68 at the same time before fastener 10 can be opened. The fact that the two forces 76 are in opposite directions in the preferred embodiment makes it much less likely that both engagement fingers can be disengaged through accidental contact, such as when the wearer of the orthotic is engaged in sporting activities.

The use of multiple engagement teeth 64 on each engagement finger 54 also increases the strength of fastener 10 without an increase in the overall size of fastener 10. This is achieved because shoulder 72 on multiple engagement teeth 64 are simultaneously engaged with shoulders 50 on track teeth 48, thereby increasing the contacting surface area and the amount of tension that can be sustained by fastener 10. By adjusting the dimensions and configuration of fastener 10, failure strengths of over 150 pounds can be achieved for fastener 10 of the current invention, while still maintaining the slim profile of fastener 10 as shown in FIGS. 1–7. This is significantly more than the tension that is generally applied to a strap in a brace or other orthotic device and is more than hook and loop fasteners or the stitching in the sew tab can sustain without failure.

The above descriptions of certain embodiments are made for the purposes of illustration only and are not intended to be limiting in any manner. Other alterations and modifications of the preferred embodiments will become apparent to those of ordinary skill in the art upon reading this disclosure, and it is intended that the scope of the invention disclosed herein be limited only by the broadest interpretation of the appended claims to which the inventor is legally entitled.

What is claimed is:

1. A fastener comprising:

a male portion comprising an attachment point and an elongated tab;

a track along one edge of said elongated tab, said track comprising of a plurality of track teeth;

a female portion comprising an attachment point and a housing, said housing containing a passage through said housing, wherein said elongated tab can be slidably disposed in said passage and wherein said attachment point for said female portion is a rivet hole and said female portion is pivotally connected to an anchor point;

an engagement finger in said housing, said engagement finger comprising at least one engagement tooth adapted to selectively engage at least one track tooth;

wherein said engagement finger is resiliently biased toward said passage to engage said at least one engagement tooth with said at least one track tooth;

an arm, adapted to selectively disengage said at least one engagement tooth of said engagement finger from said at least one track tooth upon application of pressure to said arm; and wherein engagement of said at least one engagement tooth and said at least one track tooth prevents said elongated tab from sliding further out of said housing.

2. The fastener of claim 1 further comprising a leaf spring adapted to bias said at least one engagement tooth of said engagement finger toward said passage.

3. The fastener of claim 1 wherein said track teeth and said engagement teeth are shaped such that when engaged:

contact between a shoulder of said engagement tooth and a shoulder of said track tooth prevents said elongated tab from sliding further out from said housing; and contact between a sloping edge of said track teeth and a sloping edge of said at least one engagement tooth allows ratcheting of said elongated tab further into said housing.

4. The fastener of claim 1 wherein said housing comprises a base, a cover, and side rails, wherein said side rails are positioned to space apart said base and said cover to define said passage.

5. The fastener of claim 1 wherein said attachment point on said male portion is selected from the group consisting of a sew tab, at least one rivet hole, and a D-ring.

6. The fastener of claim 1 wherein said male attachment point is a D-ring.

7. The fastener of claim 1 wherein said male attachment point is a sew tab.

8. A fastener comprising:

a male portion comprising an attachment point and an elongated tab;

a track along one edge of said elongated tab, said track comprising of a plurality of track teeth;

a female portion comprising an attachment point and a housing, said housing containing a passage through said housing, wherein said elongated tab can be slidably disposed in said passage and wherein said attachment point for said female portion is a rivet hole and said female portion is pivotally connected to an anchor point;

an engagement finger in said housing, said engagement finger comprising at least one engagement tooth adapted to selectively engage at least one track tooth;

wherein said engagement finger is resiliently biased toward said passage to engage said at least one engagement tooth with said at least one track tooth;

an arm, adapted to selectively disengage said at least one engagement tooth of said engagement finger from said at least one track tooth upon application of pressure to said arm;

wherein engagement of said at least one engagement tooth and said at least one track tooth prevents said elongated tab from sliding further out of said housing; and wherein engagement of said at least one engagement tooth and said at least one track tooth allows the ratcheting of said elongated tab further into said housing.

9. The fastener of claim 8 further comprising a leaf spring adapted to bias said at least one engagement tooth of said engagement finger toward said passage.

10. The fastener of claim 8 wherein said track teeth and said engagement teeth are shaped such that when said engagement finger is engaged:

contact between a shoulder of said engagement tooth and a shoulder of said track tooth prevents said elongated tab from sliding further out from said housing; and contact between a sloping edge of said track teeth and a sloping edge of said at least one engagement tooth allows ratcheting of said elongated tab further into said housing.

11. The fastener of claim 8 wherein said housing comprises a base, a cover, and side rails, wherein said side rails are positioned to space apart said base and said cover to define said passage.

12. The fastener of claim 8 further comprising:

a second track on a second edge of said elongated tab, said second track comprising a plurality of track teeth;

a second engagement finger in said housing, said second engagement finger comprising at least one engagement tooth adapted to selectively engage said at least one track tooth on said second track;

wherein said second engagement finger is resiliently biased toward said passage to engage said at least one engagement tooth with said at least one track tooth on said second track;

a second arm, adapted to selectively disengage said at least one engagement tooth of said second engagement finger from said at least one track tooth of said second track upon application of pressure to said second arm;

wherein said track teeth of said first and second track and said engagement teeth of said first and second engagement fingers are shaped such that when engaged, contact between a shoulder of said engagement tooth and a shoulder of said track tooth prevents said elongated tab from sliding further out from said housing;

wherein said track teeth of said first and second track and said engagement teeth of said first and second engagement fingers are shaped such that when engaged, contact between a sloping edge of said track teeth and a sloping edge of said at least one engagement tooth allows ratcheting of said elongated tab further into said housing; and wherein both said engagement fingers must simultaneously be disengaged from said tracks for said elongated tab to slide further out of said housing.

13. The fastener of claim 8 wherein said attachment point on said male portion is selected from the group consisting of a sew tab, at least one rivet hole, and a D-ring.

14. The fastener of claim 8 wherein said male attachment point is a D-ring.

15. The fastener of claim 8 wherein said attachment point is a sew tab.

16. A fastener comprising:

a male portion comprising an attachment point and an elongated tab;

a first track along one edge of said elongated tab, said track comprising of a plurality of track teeth;

a second track on a second edge of said elongated tab, said second track comprising a plurality of track teeth;

a female portion comprising an attachment point and a housing, said housing containing a passage through said housing, wherein said elongated tab can be slidably disposed in said passage;

a first engagement finger in said housing, said first engagement finger comprising at least one engagement tooth adapted to selectively engage at least one track tooth on said first track;

wherein said first engagement finger is resiliently biased toward said passage to engage said at least one engagement tooth with said at least one track tooth on said first track;

a second engagement finger in said housing, said second engagement finger comprising at least one engagement tooth adapted to selectively engage at least one track tooth on said second track;

wherein said second engagement finger is resiliently biased toward said passage to engage said at least one engagement tooth with said at least one track tooth on said second track;

a first arm, adapted to selectively disengage said at least one engagement tooth of said first engagement finger from said at least one track tooth on said first track upon application of pressure to said first arm;

a second arm, adapted to selectively disengage said at least one engagement tooth of said second engagement finger from said at least one track tooth of said second track upon application of pressure to said second arm;

a first and second leaf spring adapted to bias said one or more engagement teeth of said first and second engagement fingers toward said passage; and wherein engagement of said at least one engagement tooth of said first and second engagement fingers with said at least one track tooth on said first and second tracks prevents said elongated tab from sliding further out of said housing; and wherein both said engagement fingers must simultaneously be disengaged from said tracks for said elongated tab to slide further out of said housing.

17. The fastener of claim 16 wherein engagement of said at least one engagement tooth of said first and second engagement fingers and said at least one track tooth of said first and second tracks allows the ratcheting of said elongated tab further into said housing.

18. The fastener of claim 16 wherein said track teeth on said first and second tracks and said engagement teeth on said first and second engagement fingers are shaped such that when engaged:

contact between a shoulder of said engagement tooth and a shoulder of said track tooth prevents said elongated tab from sliding further out from said housing; and contact between a sloping edge of said track teeth and a sloping edge of said at least one engagement tooth allows ratcheting of said elongated tab further into said housing.

19. The fastener of claim 16 wherein said housing comprises a base, a cover, and side rails, wherein said side rails are positioned to space apart said base and said cover to define said passage.

20. The fastener of claim 19 wherein said attachment point on said female portion is a rivet hole in said base.

21. The fastener of claim 16 wherein said attachment points on said male and said female portion are selected from the group consisting of a sew tab, at least one rivet hole, and a D-ring.

22. The fastener of claim 16 wherein said attachment point for said female portion is a rivet hole and said female portion is pivotally connected to an anchor point.

23. The fastener of claim 16 wherein one of said attachment points is a D-ring.

24. The fastener of claim 16 wherein one of said attachment points is a sew tab.

* * * * *